US006728997B1

(12) United States Patent
Savicki et al.

(10) Patent No.: US 6,728,997 B1
(45) Date of Patent: May 4, 2004

(54) CLOSURE DEVICE

(75) Inventors: Alan F. Savicki, Oswego, IL (US); Timothy L. La Rocque, Oak Forest, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 10/049,445

(22) PCT Filed: Jun. 6, 2000

(86) PCT No.: PCT/US00/40119

§ 371 (c)(1),
(2), (4) Date: Feb. 5, 2002

(87) PCT Pub. No.: WO01/94223

PCT Pub. Date: Dec. 13, 2001

(51) Int. Cl.[7] ..... B65D 33/25; A44B 19/16

(52) U.S. Cl. ..... 24/399; 24/400; 24/415; 383/64

(58) Field of Search ..... 24/415, 399, 400, 24/585.12; 383/64, 65

(56) References Cited

U.S. PATENT DOCUMENTS

| | | | | | |
|---|---|---|---|---|---|
| 2,514,750 | A | * | 7/1950 | Dobbs | 383/64 |
| 3,153,269 | A | * | 10/1964 | Berry | 24/400 |
| 3,230,593 | A | * | 1/1966 | Herz | 24/399 |
| 3,259,951 | A | * | 7/1966 | Zimmerman | 24/399 |
| 3,522,639 | A | | 8/1970 | Frohlich | |
| 3,579,747 | A | | 5/1971 | Hawley | |
| 3,806,998 | A | | 4/1974 | Laguerre | |
| 4,829,641 | A | | 5/1989 | Williams | |
| 5,007,143 | A | | 4/1991 | Herrington | |
| 5,010,627 | A | | 4/1991 | Herrington et al. | |
| 5,664,299 | A | | 9/1997 | Porchia | |
| 5,950,285 | A | * | 9/1999 | Porchia et al. | 24/400 |
| 6,292,986 | B1 | * | 9/2001 | Provan et al. | 24/415 |
| 6,293,701 | B1 | * | 9/2001 | Tomic | 383/64 |

* cited by examiner

*Primary Examiner*—Robert J. Sandy
(74) *Attorney, Agent, or Firm*—Thomas C. Feix

(57) ABSTRACT

The closure device includes interlocking fastening strips and a slider slidably disposed on the fastening strips for facilitating the occlusion and deocclusion of the fastening strips. The external surface of the slider is designed to alter the way in which the slider will be grasped by the user. By providing outwardly protruding surfaces on the side portions of the slider, the slider will be grasped near the front or back of the slider. Thus, the user experiences a feeling that the slider is easier to move along the fastening strips. In another embodiment, by providing a gripping surface near the top portion of the slider, the slider will be grasped near the top portion of the slider. Thus, the slider will be easier to move and the slider reduces the tearing that may result when too much pressure is applied to the bottom portion of the slider during movement of the slider.

14 Claims, 12 Drawing Sheets

CLOSURE DEVICE

FIELD OF THE INVENTION

The present invention relates generally to closure devices and, more particularly, to a slider having a shape which causes the user to grip the slider in a predetermined manner. The invention is particularly well suited for flexible storage containers, including plastic bags.

BACKGROUND OF THE INVENTION

The use of closure devices for fastening storage containers, including plastic bags, is generally known. Furthermore, the manufacture of closure devices made of plastic materials is generally known to those skilled in the art, as demonstrated by the numerous patents in this area.

A particularly well known use for closure devices is in connection with flexible storage containers, such as plastic bags. In some instances, the closure device and the associated container are formed from thermoplastic materials, and the closure device and the sidewalls of the container are integrally formed by extrusion as a single piece. Alternatively, the closure device and sidewalls of the container may be formed as separate pieces and then connected by heat sealing or any other suitable connecting process. In either event, such closure devices are particularly useful in providing a closure means for retaining matter within the bag.

Conventional closure devices typically utilize mating fastening strips or closure elements, which are used to selectively seal the bag. A slider may be provided for use in opening and closing the fastening strips. Some of these sliders may include a separator which extends at least partially between the fastening strips. When the slider is moved in the appropriate direction, the separator divides the fastening strips and opens the bag.

One of the difficulties involved with using a slider is the manner in which the user grips the slider. Generally, the slider is gripped in the center. This situation requires that the slider be pulled which requires more force than if the slider were pushed. Additionally, if the slider is gripped towards the bottom, the shoulders of the slider may tear into the sidewalls of the plastic container or the fastening strips.

SUMMARY OF THE INVENTION

The present invention provides a closure device with a slider having a specific shape that results in the slider being gripped in a certain fashion. The closure device comprises first and second interlocking fastening strips arranged to be interlocked over a predetermined length. The slider is slidably disposed on the interlocking fastening strips for facilitating the occlusion and deocclusion of the fastening strips when moved towards first and second ends of the fastening strips. The external surface of the slider is designed to alter the way in which the slider will be grasped by the user. By providing outwardly protruding portions on the side portions of the slider, the slider will be grasped near the front or back of the slider. Thus, the slider will be easier to move along the fastening strips because the gripping forces by the user will be reduced. In another embodiment, by providing a gripping surface near the top portion of the slider, the slider will be grasped near the top portion of the slider. Thus, the slider will be easier to move and the slider reduces the tearing that may result when too much pressure is applied to the bottom portion of the slider during movement of the slider.

The present invention will become more readily apparent upon reading the following detailed description of exemplified embodiments and upon reference to the accompanying drawings herein.

DESCRIPTION OF THE EMBODIMENTS

Figure 1:
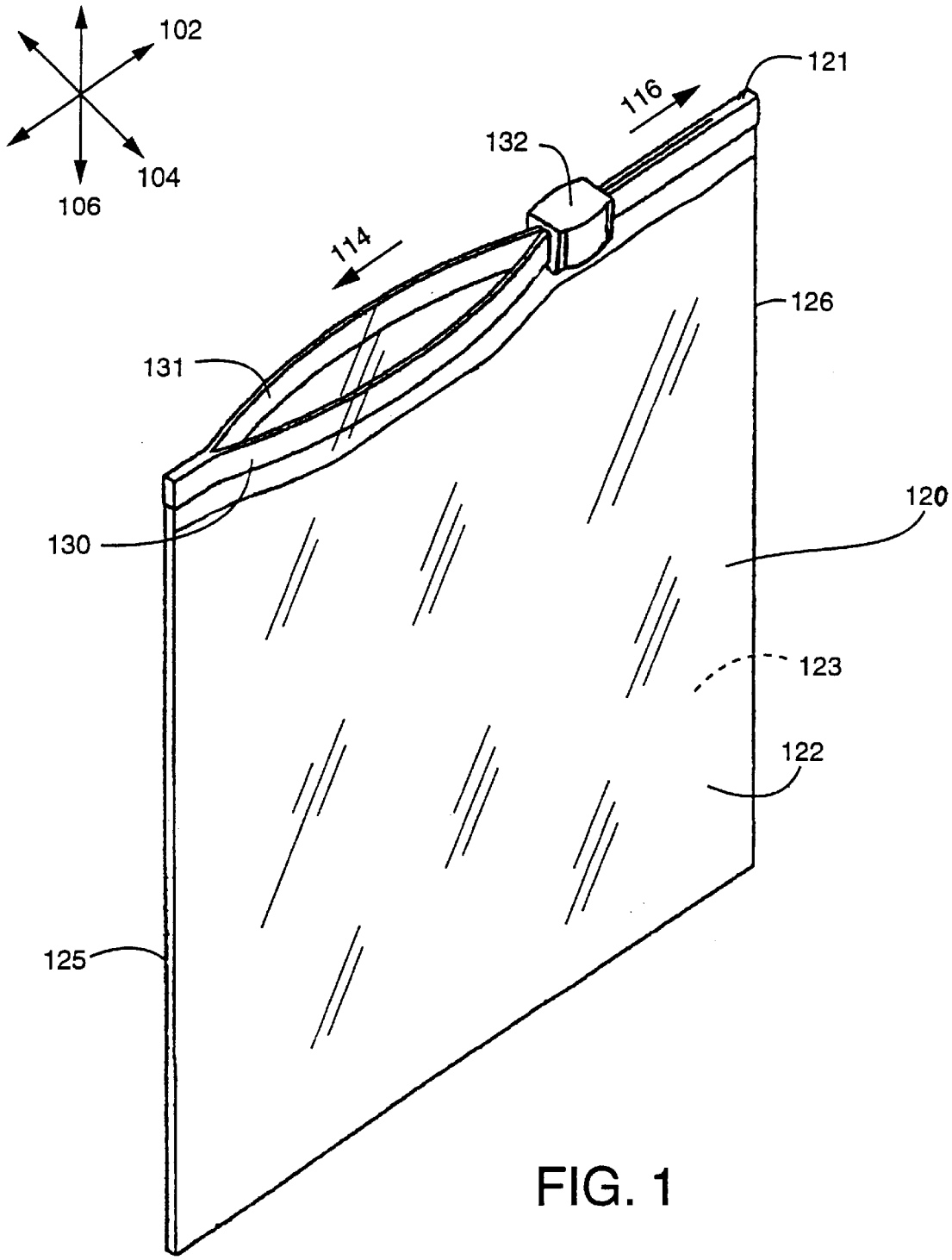
FIG. 1 is a perspective view of a container according to the present invention in the form of a plastic bag.

FIG. 1 illustrates an embodiment of a container in the form of a plastic bag 120 having a sealable closure device 121. The bag 120 includes a first sidewall 122 and a second sidewall 123 joined at seams 125, 126 to define a compartment accessible through the open top end but sealable by means of the closure device 121. The closure device 121 includes first and second fastening strips 130, 131 and a slider 132.

The fastening strips 130, 131 and the slider 132 have a longitudinal X axis 102, a transverse Y axis 104 and a vertical Z axis 106. The transverse Y axis 104 is perpendicular to the longitudinal X axis 102. The vertical Z axis 106 is perpendicular to the longitudinal X axis 102 and the vertical Z axis 106 is perpendicular to the transverse Y axis 104.

The slider 132 is mounted onto the fastening strips 130, 131 so that the slider 132 is restrained from being removed from the fastening strips 130, 131 but free to slide along the X axis 102. The slider 132 engages the fastening strips 130, 131 so that when the slider 132 moves in an occlusion direction 114, the fastening strips 130, 131 interlock and the bag 120 is sealed, and when the slider 132 moves in a deocclusion direction 116, the fastening strips 130, 131 separate and the bag 120 is open.

Figure 2:
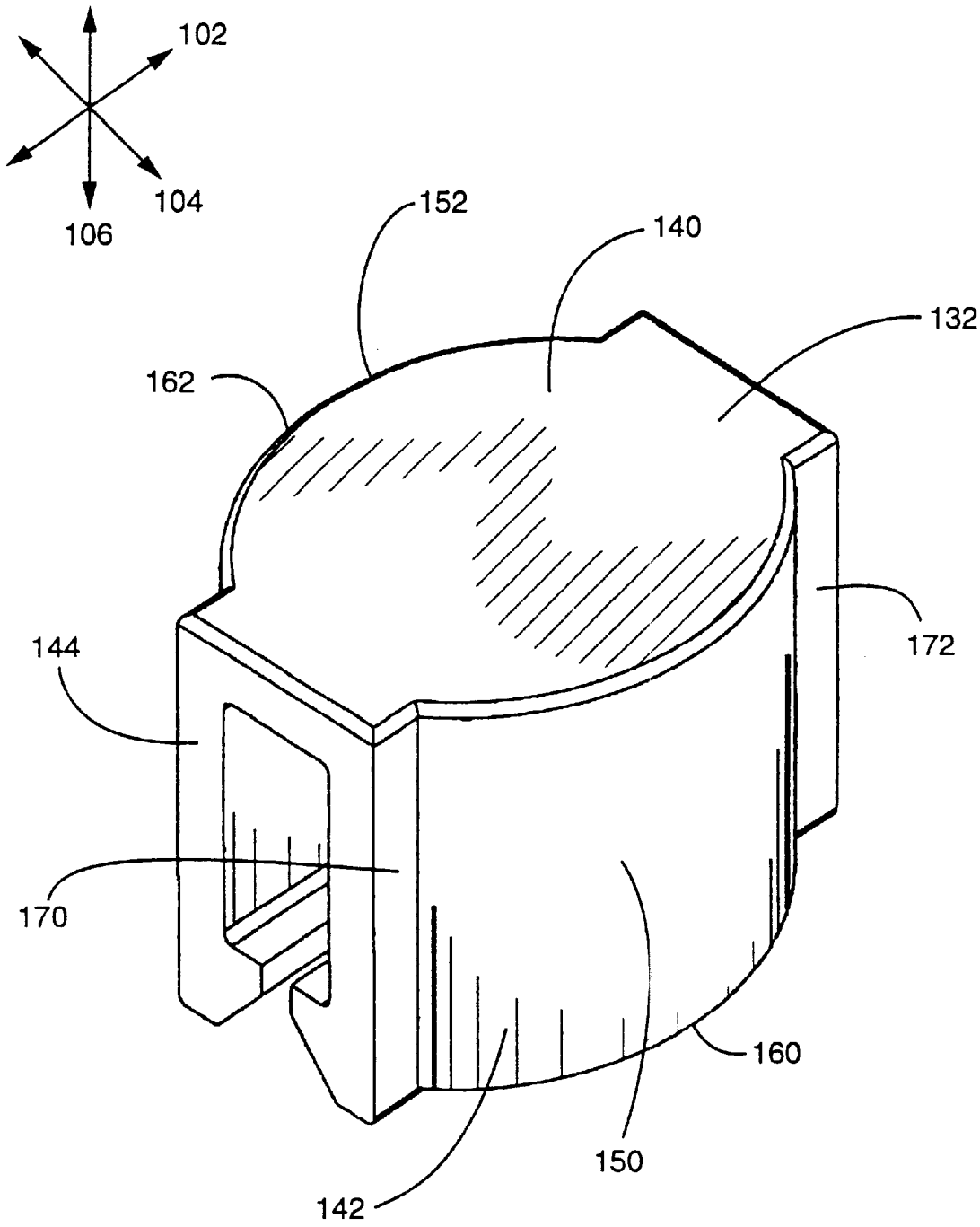
FIG. 2 is a perspective view of a slider.

FIG. 2 illustrates a perspective view of a slider that may be used with the closure device depicted in FIG. 1. The slider 132 includes a top portion 140. The top portion 140 of the slider merges into a first side portion 142 and a second side portion 144. The first side portion 142 has a first protruding portion 150. Similarly, the second side portion 144 has a second protruding portion 152. The first protruding portion 150 and the second protruding portion 152 extend laterally along the outer surfaces of the side portions 142, 144 and include outwardly protruding radial surfaces 160, 162. The slider is wider at the center due to the protruding portions 150, 152 than at the front and rear portions 170, 172. The user has a tendency to grip the narrowest location on the slider. Therefore, due to the protruding portions 150, 152 the user will grip the slider near the front and rear portions 170, 172 as opposed to the center of the slider.

Figure 3:
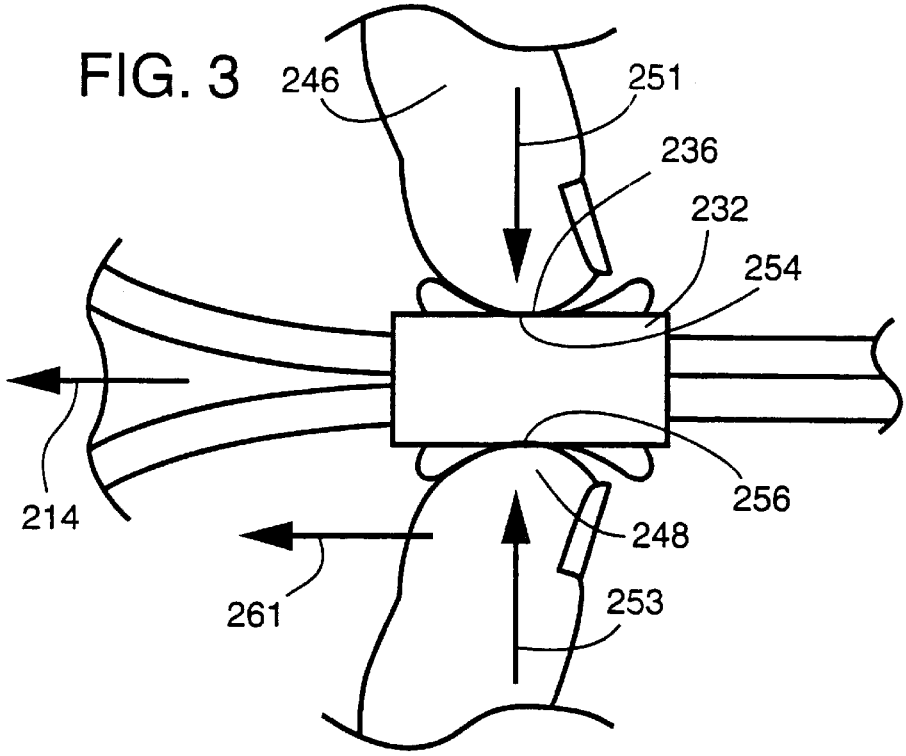
FIG. 3 is a top view of a prior art slider being gripped by the thumb and index finger of the user.

In the prior art, the slider is designed so that the user grips the slider 232 at the center 236 with the index finger 246 and the thumb 248 when the user wishes to move the slider as shown in FIG. 3. The user must exert both a pulling force and gripping forces. The user exerts gripping forces 251, 253 on the slider 232 at pressure areas 254, 256. In addition, the user exerts a pulling force 261 in order to move the slider 232 in the desired direction 214. The user experiences a feeling that the slider is difficult to move because the user must exert both the pulling force and the gripping forces in order to move the slider.

Figure 4:
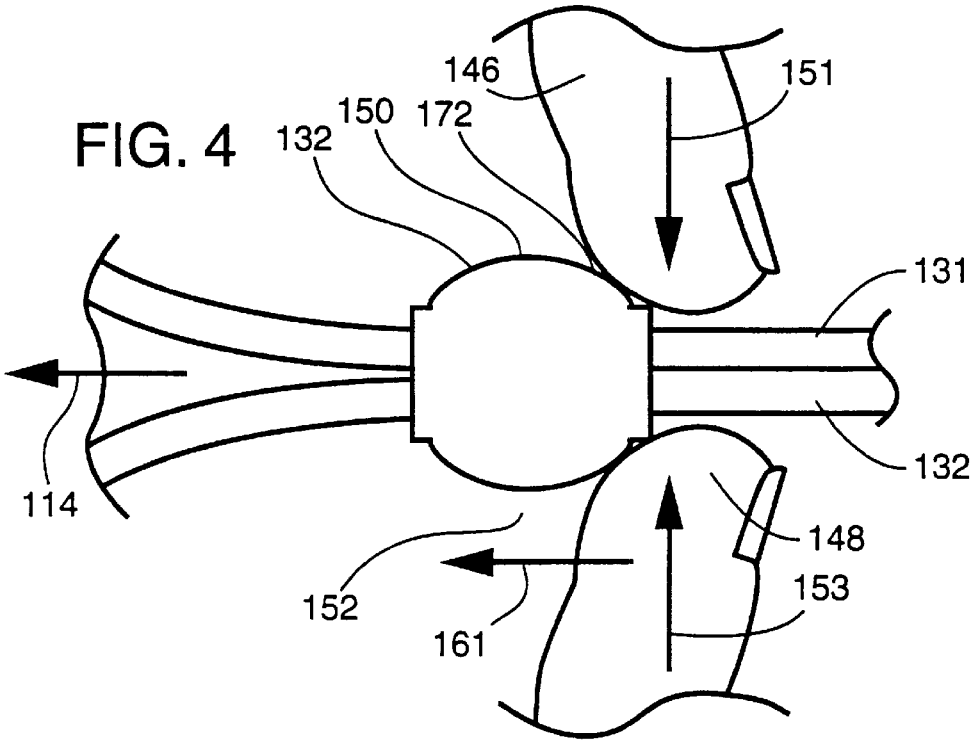
FIG. 4 is a top view of the slider in FIG. 2 being gripped by the thumb and index finger of the user.

In the present invention, the slider 132 is designed so that minimum pressure or gripping forces are needed by the index finger and the thumb to grip the slider in order to move the slider along the fastening strips. Referring to FIG. 4, the index finger 146 and thumb 148 of the user engage the slider 132 at the rear portion 172 due to the protruding portions 150, 152 as noted above. When the user engages the rear portion 172, the gripping forces 151, 153 needed by the index finger 146 and the thumb 148 to move the slider are very small. These gripping forces are very small in comparison to the gripping forces required when engaging the center of the slider. In addition, the user will exert a pushing force 161 in order to move the slider 132 in the desired direction 114. The user experiences a feeling that the slider is easier to move because the user exerts less gripping forces.

Figure 5:
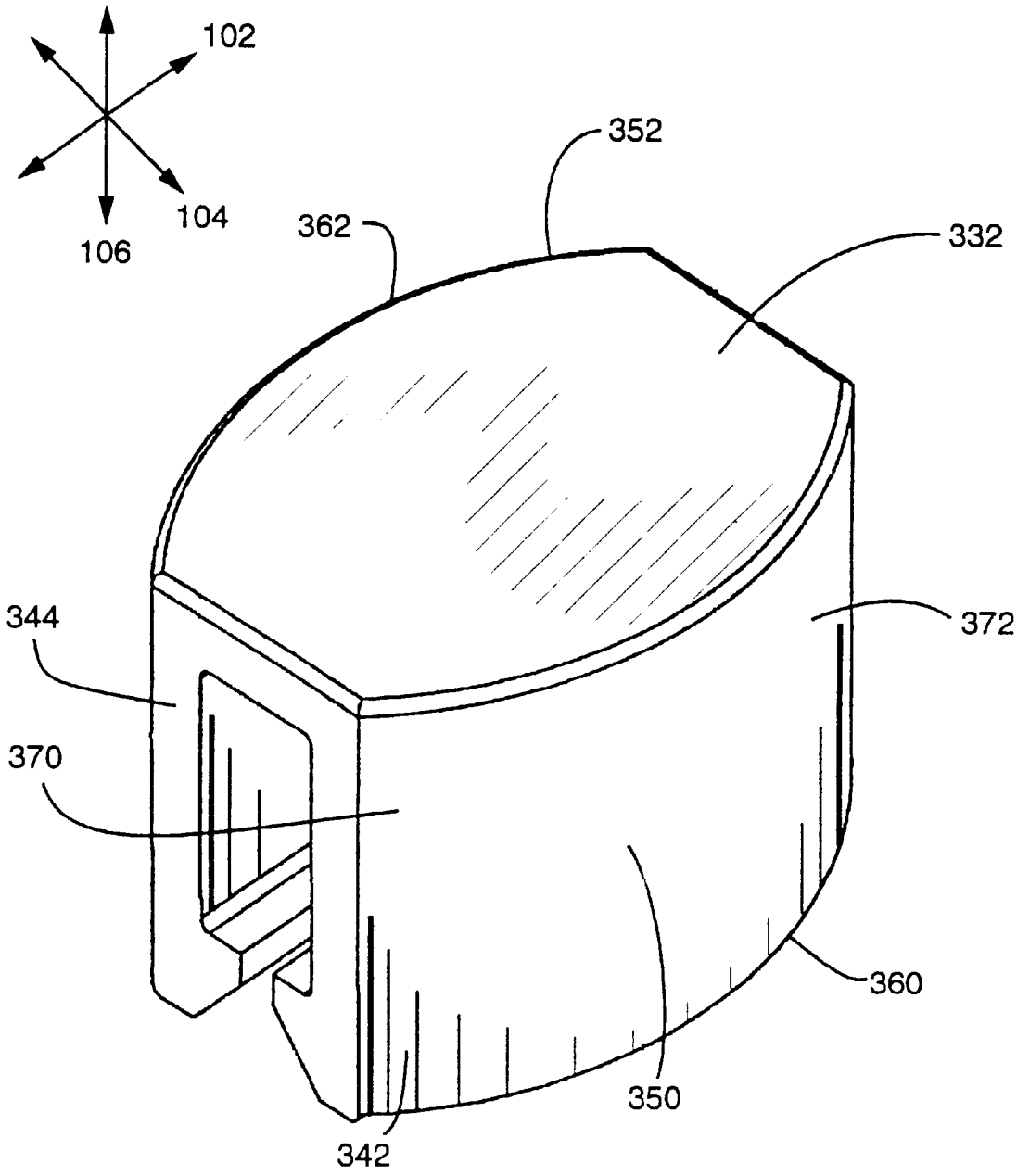
FIG. 5 is a perspective view of another embodiment of a slider.

FIG. 5 illustrates a perspective view of another embodiment of a slider 332. The slider 332 includes first and second protruding portions 350, 352 with outwardly protruding radial surfaces 360, 362 respectively. The radial surfaces 360, 362 extend laterally along the length of the side portions 342, 344. The protruding portions result in the slider being gripped near the front and rear portions 370, 372 of the slider 332. Thus, the user experiences a feeling that the slider is easier to move because the user exerts less gripping forces as noted above.

Figure 6:
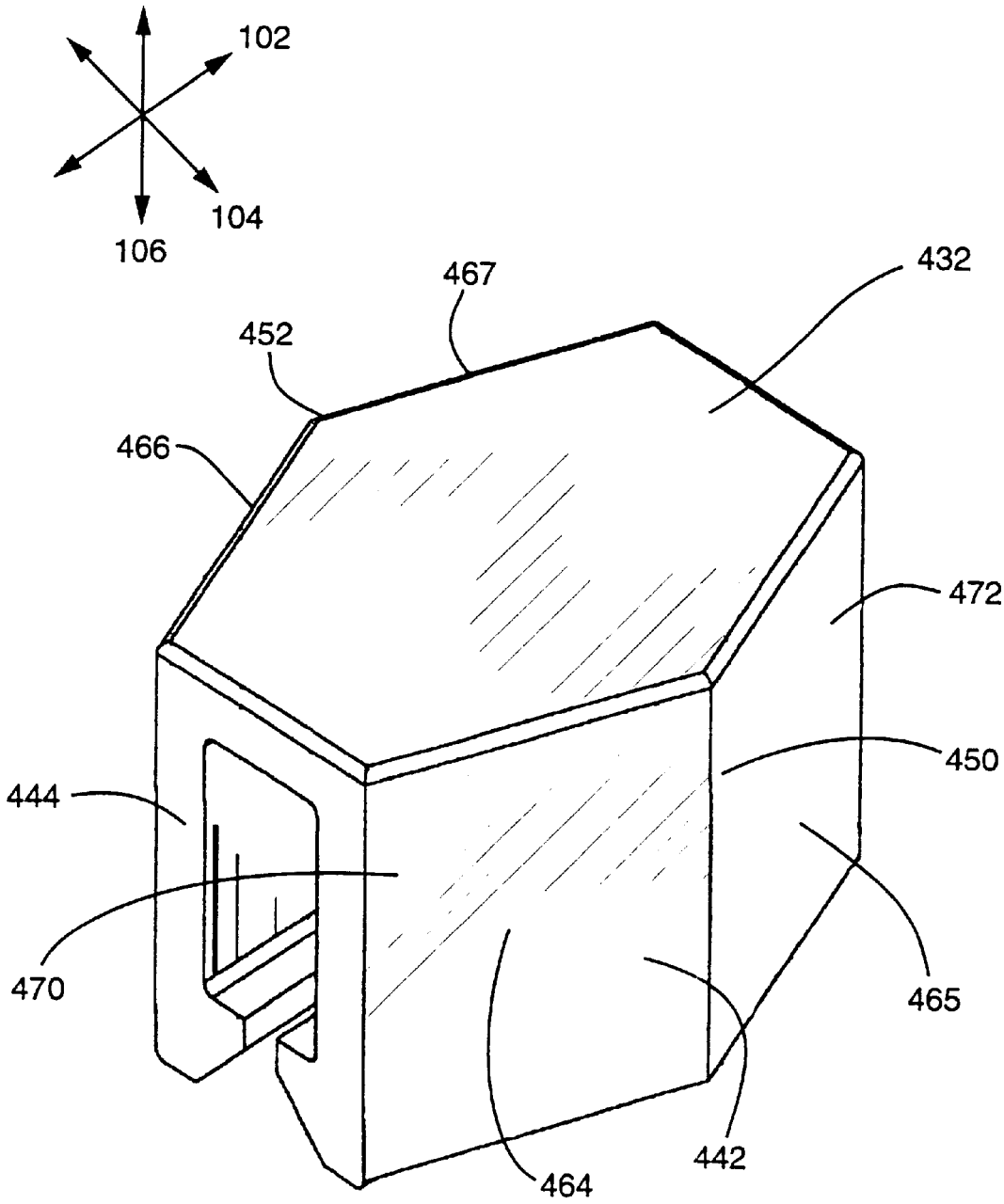
FIG. 6 is a perspective view of another embodiment of a slider.

FIG. 6 illustrates a perspective view of another embodiment of a slider 432. The slider includes first and second side portions 442, 444. The first side portion 442 includes a protruding portion 450 which includes two outwardly protruding linear surfaces 464, 465. The linear surfaces 464, 465 are joined at a point halfway along the side portion 442. Similarly, the second side portion 444 includes a protruding portion 452 which includes two outwardly protruding linear surfaces 466, 467. The linear surfaces 466, 467 are joined at a point midway along the side portion 444. The protruding portions result in the slider being gripped near the front and rear portions 470, 472 of the slider. Thus, the user experiences a feeling that the slider is easier to move because the user exerts less gripping forces as noted above.

Figure 7:
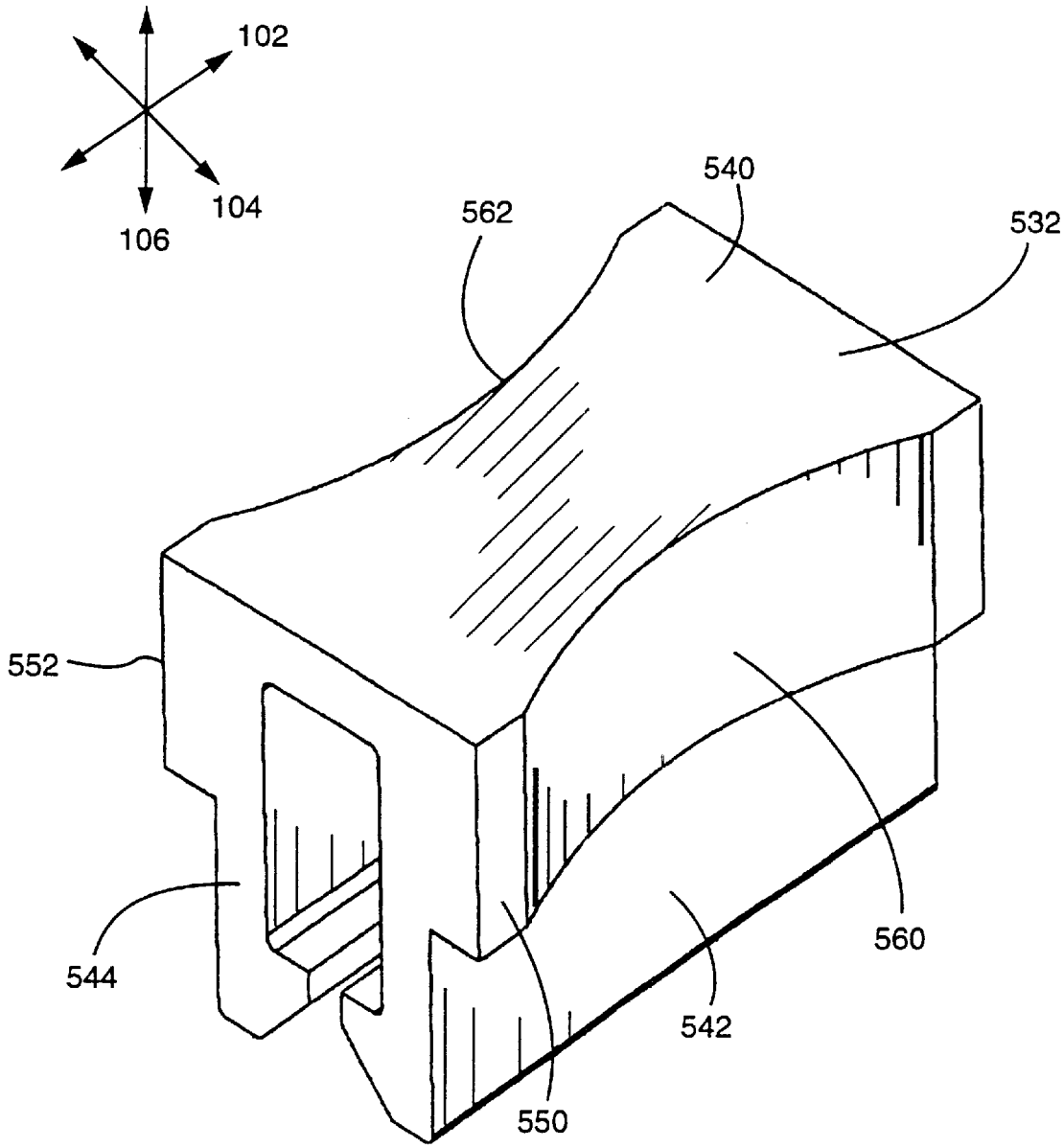
FIG. 7 is a perspective view of another embodiment of a slider.
Figure 8:
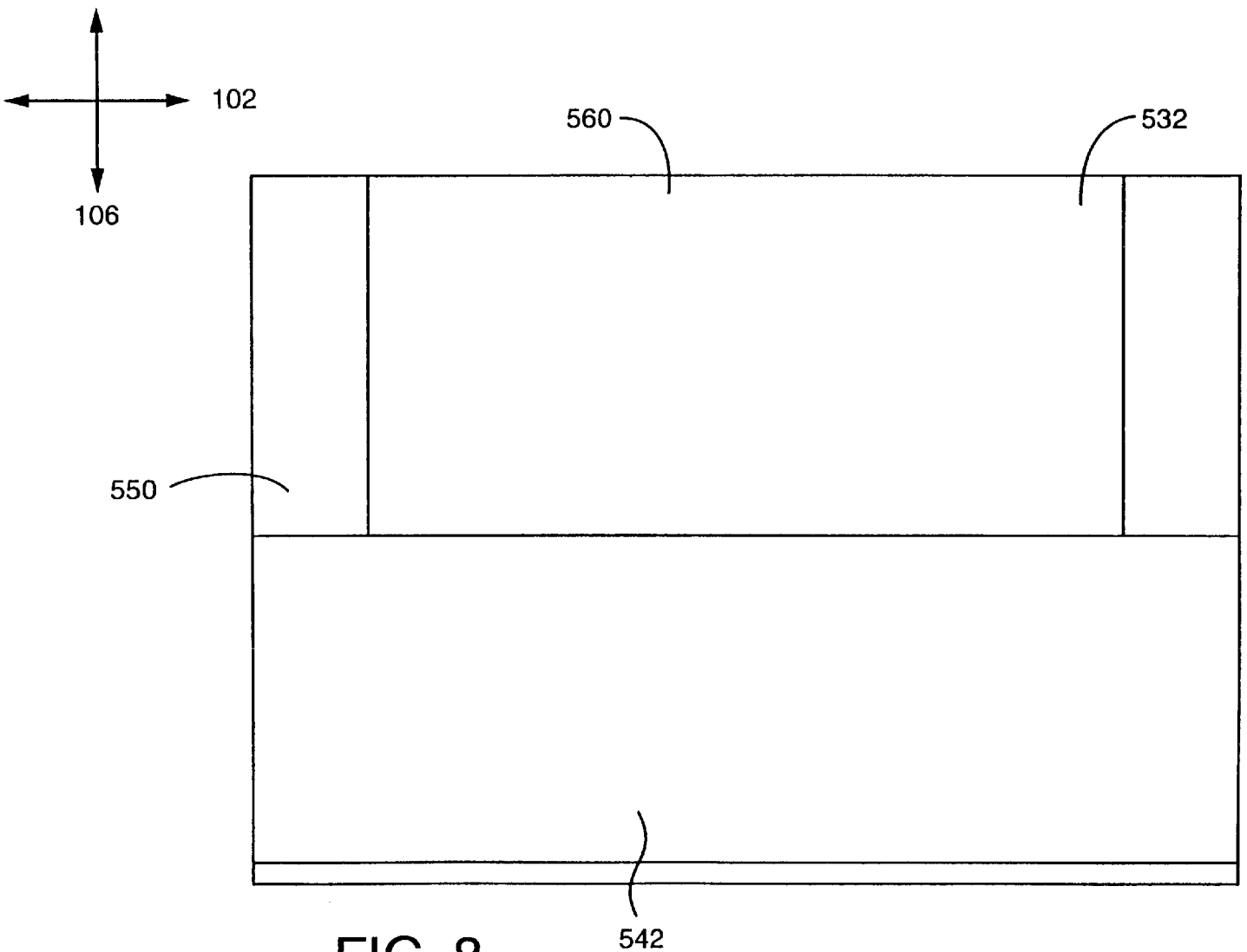
FIG. 8 is a front view of the slider in FIG. 7.
Figure 9:
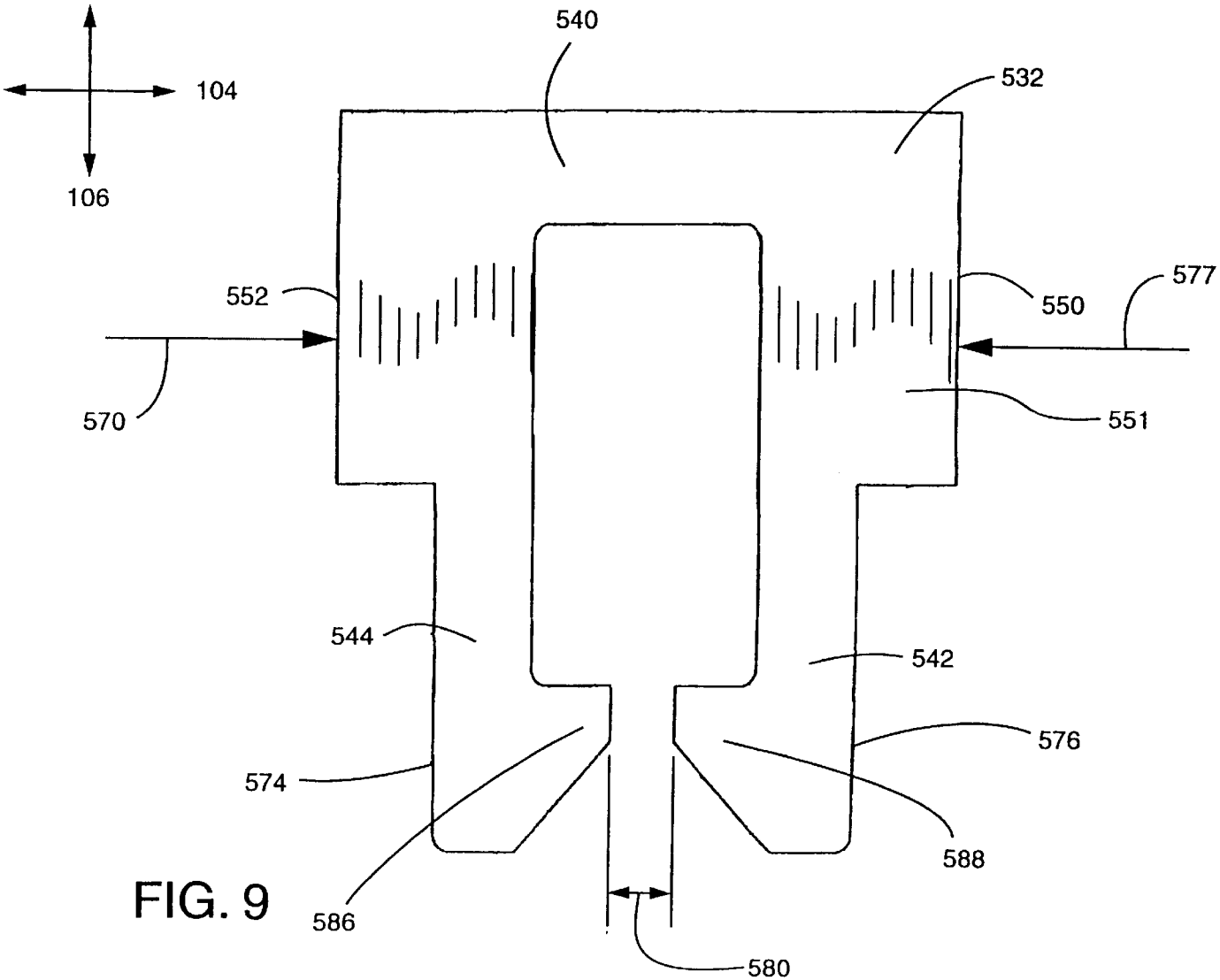
FIG. 9 is a side view of the slider in FIG. 7.

FIGS. 7–9 illustrate another embodiment of a slider 532. The slider 532 will reduce the possibility that the shoulders of the slider will damage the fastening strips or the sidewalls of the container. The slider includes a top portion 540 and first and second side portions 542, 544 attached to the top portion 540. The first side portion 542 has a first gripping surface 550 at the upper portion 551 of the slider 532. Similarly, the second side portion 544 has a second gripping surface 552 at the upper portion 551 of the slider 532. The first gripping surface 550 and the second gripping surface 552 may extend laterally along the outer surfaces of the side portions 542, 544. In addition, the gripping surfaces 550, 552 may include inwardly protruding radial surfaces 560, 562 designed to correspond to the contours of a person's fingertips. The user will have a tendency to grip the gripping surfaces 550, 552 because the gripping surfaces correspond to the thumb and index finger of the user. Therefore, as shown in FIG. 9, the user will use the thumb and index finger to apply gripping forces 570, 572 to the gripping surfaces 550, 552. The gripping surfaces 550, 552 are located in the upper portion 551 of slider and near the top surface 540 of the slider. Thus, the gripping forces 570, 572 will be applied to the upper portion of the slider 532 and near the top portion 540.

When the gripping forces 570, 572 are applied near the top portion 540, the amount of deflection in the side portions 542, 544 is less than if the same gripping forces were applied in the lower portion of the slider at locations 574, 576. If the gripping forces are applied at the lower portion of the slider, the gap 580 between the side portions 542, 544 reduces in size. If the size of the gap is reduced, then the fastening strips or sidewalls located in the gap 580 may be damaged or torn by the side portions 542, 544 or the shoulders 586, 588 during movement of the slider 532. Damage to the fastening strips or the sidewalls would be undesirable. Furthermore, if the size of the gap 580 is reduced, the side portions 542, 544 or the shoulders 586, 588 will apply more force to the fastening strips or sidewalls which will create more friction and make movement of the slider along the fastening strips more difficult. Therefore, by locating the gripping surfaces 550, 552 at the upper portion of the slider, the slider will cause less damage to the container and the slider is easier to move along the fastening strips.

Figure 10:
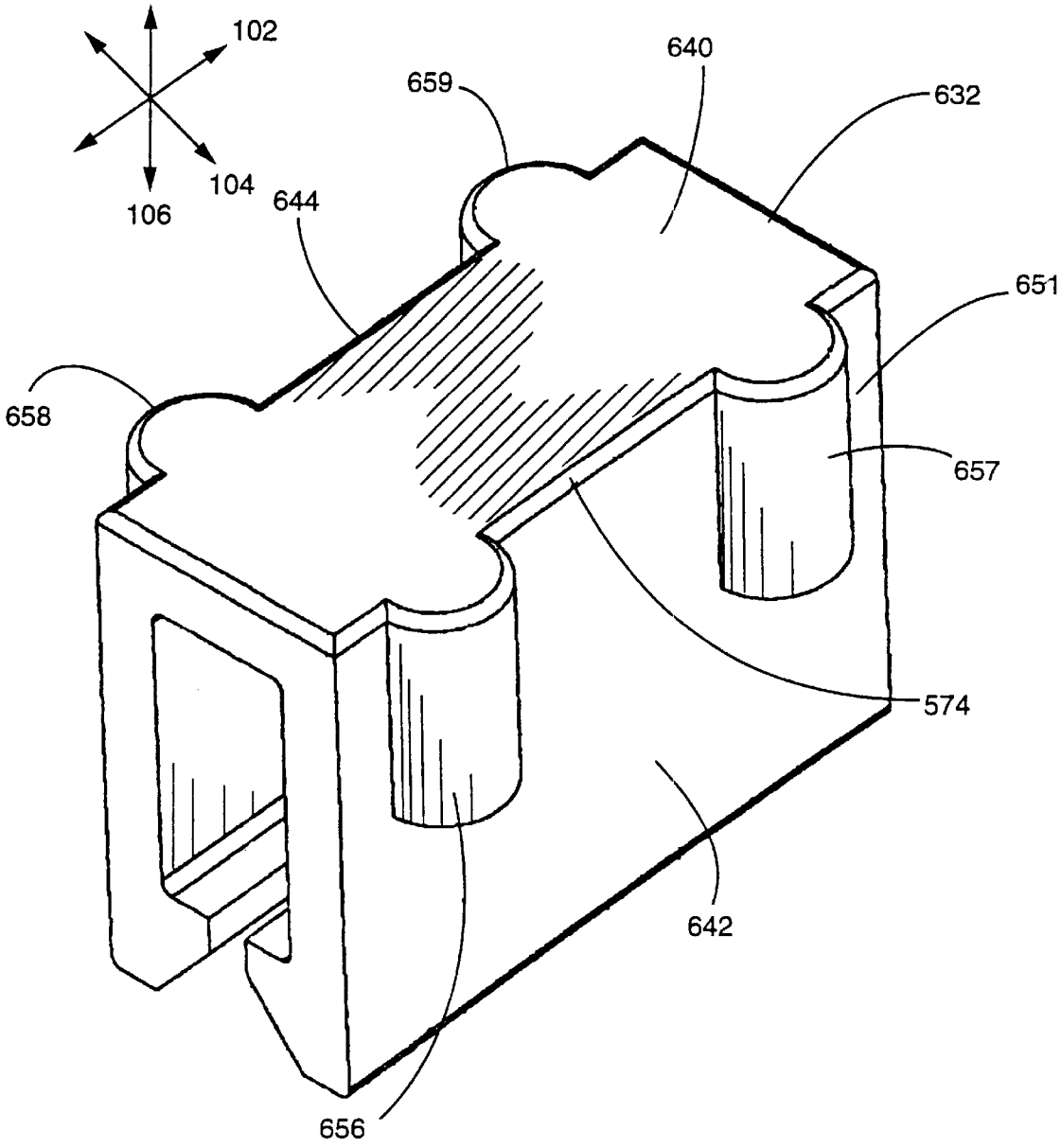
FIG. 10 is a perspective view of another embodiment of a slider.

FIG. 10 illustrates a perspective view of another embodiment of a slider 632. The slider includes a top portion 640, a first side portion 642 and a second side portion 644. The first side portion 642 includes two outwardly protruding bumps 656, 657 disposed at the upper portion 651 of the slider 632. Similarly, the second side portion 644 includes two outwardly protruding bumps 658, 659 disposed at the upper portion 651 of the slider 632. The bumps 656, 657, 658, 659 facilitate the gripping of the slider 632 at the upper portion of the slider 632. The bumps assist in creating a gripping surface which corresponds to the thumb and index finger of the user. As noted above, by locating the gripping surfaces at the upper portion of the slider, the slider will cause less damage to the container and the slider is easier to move along the fastening strips.

The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terephthalate, high density polyethylene, polycarbonate or ABS (acrylonitrile-butadiene-styrene).

Figure 11:
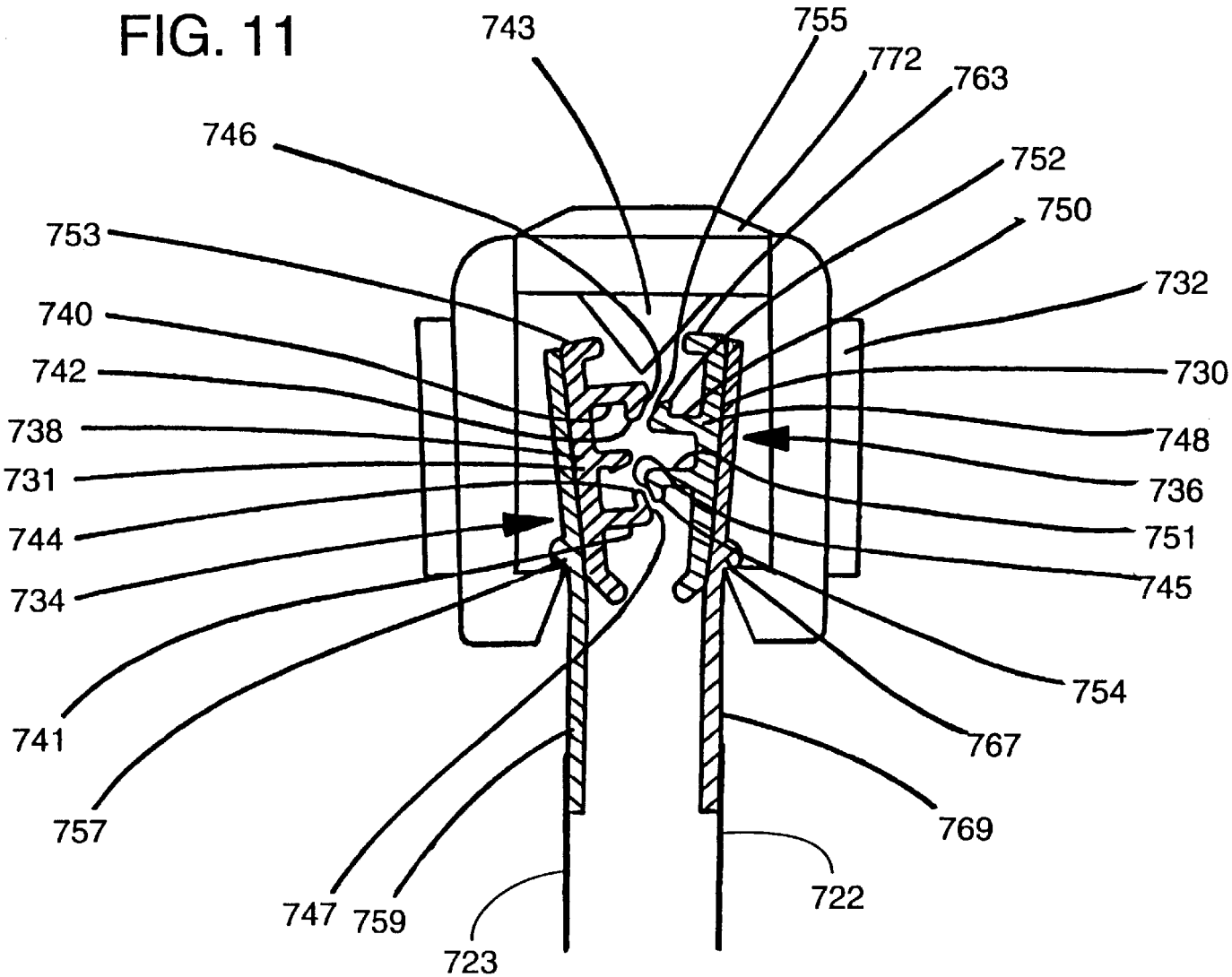
FIG. 11 is a cross-sectional view of an embodiment of fastening strips and a slider.

As shown in FIG. 11, the fastening strips may be U-channel fastening strips as described in U.S. Pat. No. 4,829,641. U-channel fastening strips include a first fastening strip 730 with a first closure element 736 and a second fastening strip 731 with a second closure element 734. The first closure element 736 engages the second closure element 734. The first fastening strip 730 may include a flange 763 disposed at the upper end of the first fastening strip 730 and a rib 767 disposed at the lower end of the first fastening strip 730. The first fastening strip 730 may include a flange portion 769. Likewise, the second fastening strip 731 may include a flange 753 disposed at the upper end of the second fastening strip 731 and a rib 757 disposed at the lower end of the second fastening strip 731. The second fastening strip 731 may include a flange portion 769. The side walls 722, 723 of the plastic bag 720 may be attached to the fastening strips 730, 731 by conventional manufacturing techniques.

The second closure element 734 includes a base portion 738 having a pair of spaced-apart parallely disposed webs 740, 741, extending from the base portion 738. The base and the webs form a U-channel closure element. The webs 740, include hook closure portions 742, 744 extending from the webs 740, 741 respectively, and facing towards each other. The hook closure portions 742, 744 include guide surfaces 746, 747 which serve to guide the hook closure portions 742, 744 for occluding with the hook closure portions 752, 754 of the first closure element 736.

The first closure element 736 includes a base portion 748 including a pair of spaced-apart, parallely disposed webs 750, 751 extending from the base portion 748. The base and the webs form a U-channel closure element. The webs 750, 751 include hook closure portions 752, 754 extending from the webs 750, 751 respectively and facing away from each other. The hook closure portions 752, 754 include guide surfaces 745, 755, which generally serve to guide the hook closure portions 752, 754 for occlusion with the hook closure portions 742, 744 of the second closure element 734. The guide surfaces 745, 755 may also have a rounded crown surface.

The slider 732 includes a top portion 772. The top portion provides a separator 743 having a first end and a second end wherein the first end may be wider than the second end. In addition, the separator 743 may be triangular in shape. When the slider is moved in the occlusion direction, the separator 743 deoccludes the fastening strips 730, 731 as shown in FIG. 11. Referring to FIG. 11, the closure elements 734, 736 are deoccluded and specifically, the upper hook portions 742, 752 and the lower hook portions 744, 754 are deoccluded.

Figure 12:
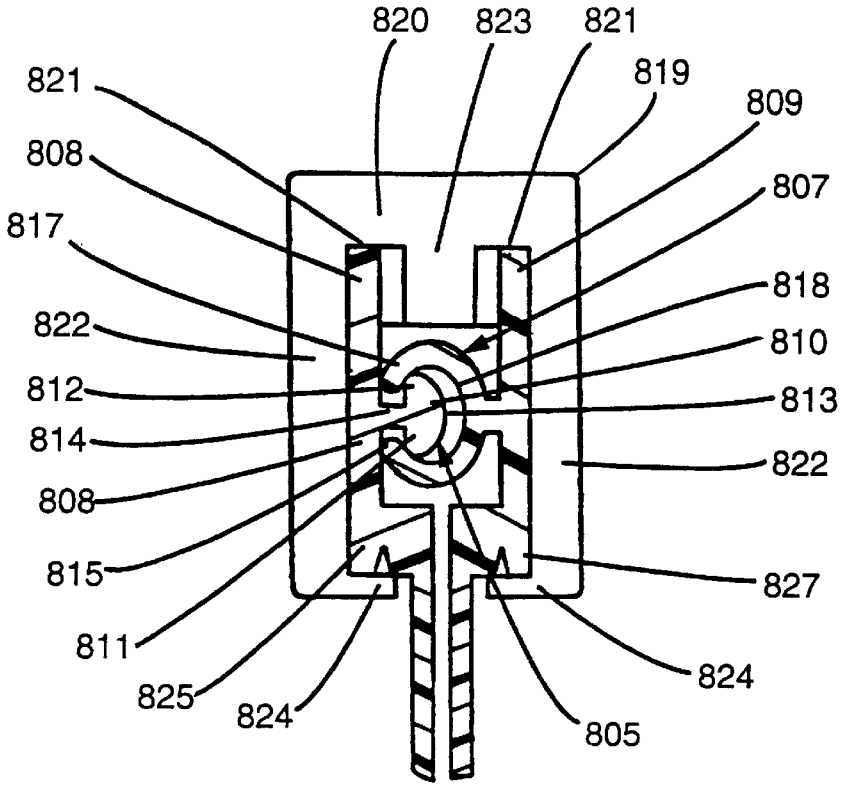
FIG. 12 is a cross-sectional view of another embodiment of fastening strips and a slider.

The interlocking fastening strips may comprise "arrowhead-type" or "rib and groove" fastening strips as shown in FIG. 12 and as described in U.S. Pat. No. 3,806,998. The rib element 805 interlocks with the groove element 807. The rib element 805 is of generally arrow-shape in transverse cross section including a head 810 comprising interlock shoulder hook portions 811 and 812 generally convergently related to provide a cam ridge 813 generally aligned with a stem flange 814 by which the head is connected in spaced relation with respect to the supporting flange portion 808. (U.S. Pat. No. 3,806,998, Col. 2, lines 16–23). At their surfaces nearest the connecting stem flange 814, the shoulder portions 811 and 812 define reentrant angles therewith providing interlock hooks engageable with interlock hook flanges 815 and 817 respectively of the groove element 807. (U.S. Pat. No. 3,806,998, Col. 2, lines 23–28). Said hook flanges generally converge toward one another and are spread open to receive the head 810 therebetween when said head is pressed into said groove element 807 until the head is fully received in a groove 818 of said groove element 807 generally complementary to the head and within which the head is interlocked by interengagement of the head shoulder hook portions 811 and 812 and the groove hook flanges 815 and 817. (U.S. Pat. No. 3,806,998, Col. 2, lines 28–36). Through this arrangement, as indicated, the head and groove elements 805 and 807 are adapted to be interlockingly engaged by being pressed together and to be separated when forcably pulled apart, as by means of a generally U-shaped slider 819. (U.S. Pat. No. 3,806,998, Col. 2, lines 36–41).

The slider 819 includes a flat back plate 820 adapted to run along free edges 821 on the upper ends of the sections of the flange portions 808 and 809 as shown in the drawing. (U.S. Pat. No. 3,806,998, Col. 2, lines 41–46). Integrally formed with the back plate 820 and extending in the same direction (downwardly as shown) therefrom are respective coextensive side walls 822 with an intermediate spreader finger 823 extending in the same direction as the side walls at one end of the slider. (U.S. Pat. No. 3,806,998, Col. 2, lines 46–51). The side walls 822 are in the form of panels which are laterally divergent from a narrower end of the slider. (U.S. Pat. No. 3,806,998, Col. 2, lines 51–55). The slider walls 822 are each provided with an inwardly projecting shoulder structure 824 flange adapted to engage respective shoulder ribs 825 and 827 on respectively outer sides of the lower section of the flange portions 808 and 809. (U.S. Pat. No. 3,806,998, Col. 2, line 66 to Co. 3, line 3).

Figure 13:
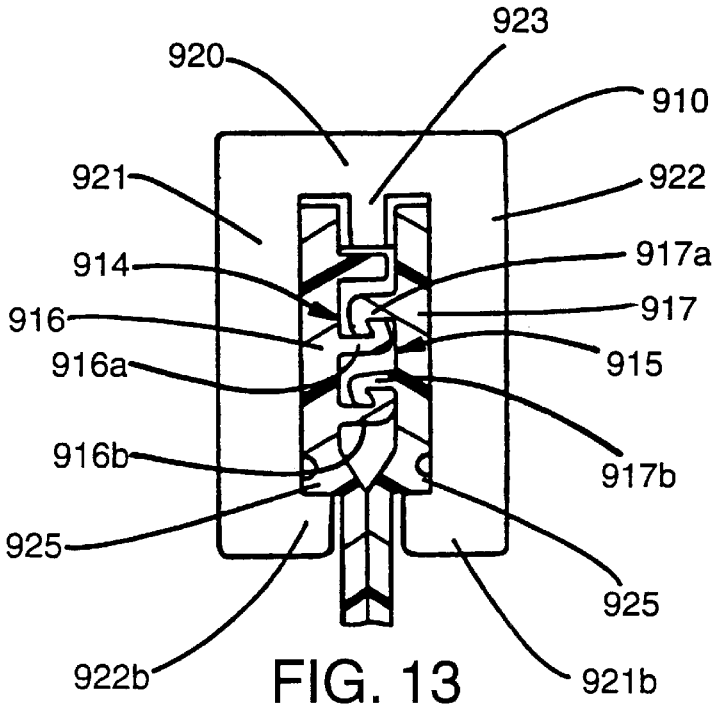
FIG. 13 is a cross-sectional view of another embodiment of fastening strips and a slider.

Additionally, the interlocking fastening strips may comprise "profile" fastening strips, as shown in FIG. 13 and described in U.S. Pat. No. 5,664,299. As shown in FIG. 13, the first profile 916 has at least an uppermost closure element 916*a* and a bottommost closure element 916*b*. (U.S. Pat. No. 5,664,299, Col. 3, lines 25–27). The closure elements 916*a* and 916*b* project laterally from the inner surface of strip 914. (U.S. Pat. No. 5,664,299, Col. 3, lines 27–28). Likewise, the second profile 917 has at least an uppermost closure element 917*a* and a bottommost closure element 917*b*. (U.S. Pat. No. 5,664,299, Col. 3, lines 28–30). The closure elements 917*a* and 917*b* project laterally from the inner surface of strip 915. (U.S. Pat. No. 5,664,299, Col. 3, lines 30–32). When the bag is closed, the closure elements of profile 916 interlock with the corresponding closure elements of profile 917. (U.S. Pat. No. 5,664,299, Col. 3, lines 32–34). As shown in FIG. 19, closure elements 916*a*, 916*b*, 917*a* and 917*b* have hooks on the ends of the closure elements, so that the profiles remain interlocked when the bag is closed, thereby forming a seal. (U.S. Pat. No. 5,664,299, Col. 3, lines 34–37).

The straddling slider 910 comprises an inverted U-shaped member having a top 920 for moving along the top edges of the strips 914 and 915. (U.S. Pat. No. 5,664,299, Col. 4, lines 1–3). The slider 910 has side walls 921 and 922 depending from the top 920. (U.S. Pat. No. 5,664,299, Col. 4, lines 3–4). A separating leg 923 depends from the top 920 between the side walls 921 and 922 and is located between the uppermost closure elements 916*a* and 917*a* of profiles 916 and 917. (U.S. Pat. No. 5,664,299, Col. 4, lines 26–30). The fastening assembly includes ridges 925 on the outer surfaces of the fastening strips 914 and 915, and shoulders 921*b* and 922*b* on the side walls of the slider. (U.S. Pat. No. 5,664,299, Col. 4, lines 62–65). The shoulders act as means for maintaining the slider in straddling relation with the fastening strips by grasping the lower surfaces of the ridges 925. (U.S. Pat. No. 5,664,299, Col. 5, lines 4–7).

Figure 14:
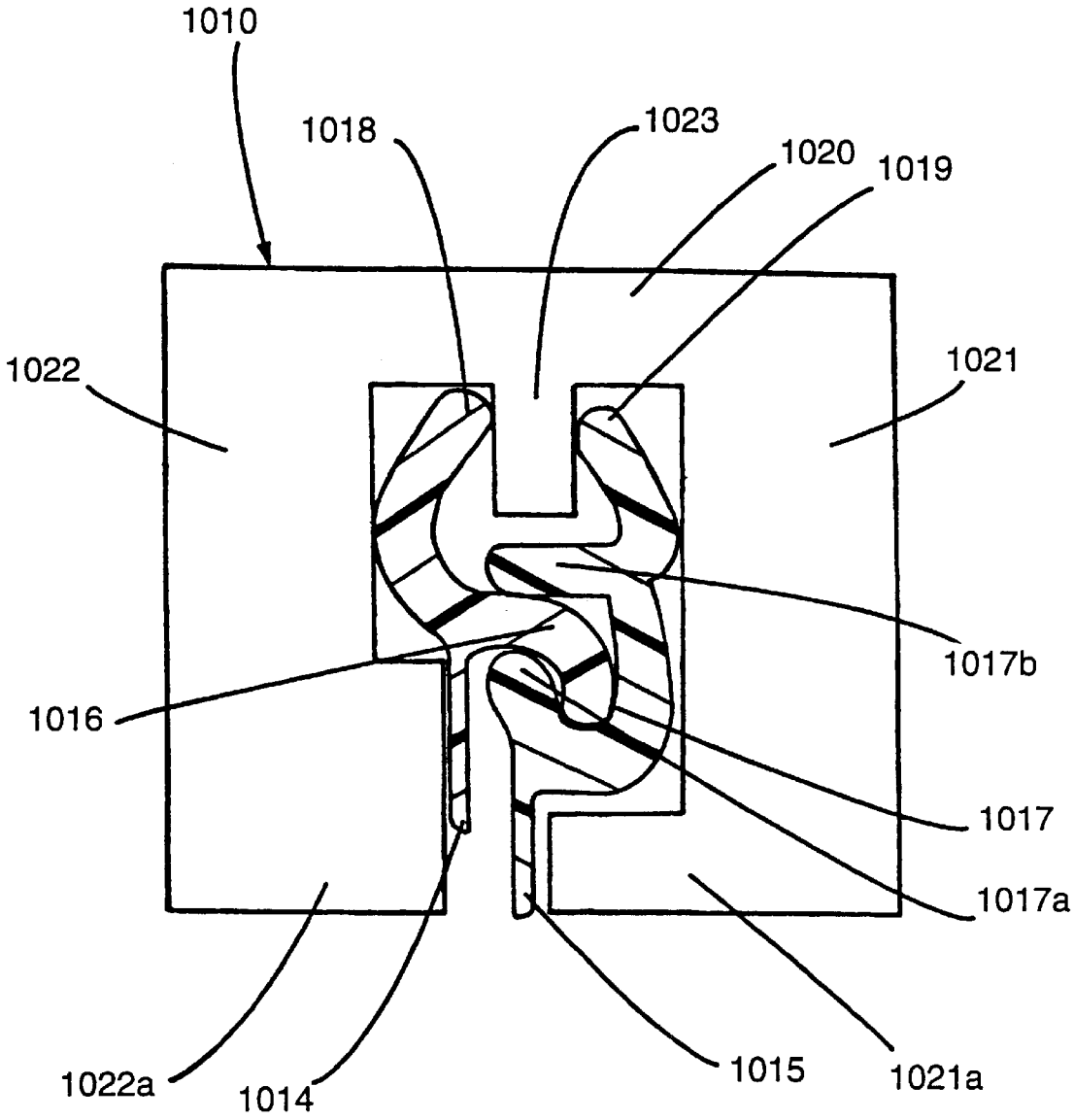
FIG. 14 is a cross-sectional view of another embodiment of fastening strips and a slider.

Also, the interlocking fastening strips may be "rolling action" fastening strips as shown in FIG. 14 and described in U.S. Pat. No. 5,007,143. The strips 1014 and 1015 include profiled tracks 1018 and 1019 extending along the length thereof parallel to the rib and groove elements 1016 and 1017 and the rib and groove elements 1016, 1017 have complimentary cross-sectional shapes such that they are closed by pressing the bottom of the elements together first and then rolling the elements to a closed position toward the top thereof. (U.S. Pat. No. 5,007,143, Col. 4, line 62 to Col. 5, line 1). The rib element 1016 is hook shaped and projects from the inner face of strip 1014. (U.S. Pat. No. 5,007,143, Col. 5, lines 1–3). The groove element 1017 includes a lower hook-shaped projection 1017*a* and a relatively straight projection 1017*b* which extend from the inner face of strip 1015. (U.S. Pat. No. 5,007,143, Col. 5, lines 3–6). The profiled tracks 1018 and 1019 are inclined inwardly toward each other from their respective strips 1014 and 1015. (U.S. Pat. No. 5,007,143, Col. 5, lines 6–8).

The straddling slider 1010 comprises an inverted U-shaped plastic member having a back 1020 for moving along the top edges of the tracks 1018 and 1019 with side walls 1021 and 1022 depending therefrom for cooperating with the tracks and extending from an opening end of the slider to a closing end. (U.S. Pat. No. 5,007,143, Col. 5, lines 26–31). A separator finger 1023 depends from the back 1020 between the side walls 1021 and 1022 and is inserted between the inclined tracks 1018 and 1019. (U.S. Pat. No. 5,007,143, Col. 5, lines 34–36). The slider 1010 has shoulders 1021*a* and 1022*a* projecting inwardly from the depending side walls 1021 and 1022 which are shaped throughout the length thereof for cooperation with the depending separator finger 1023 in creating the rolling action in opening and closing the reclosable interlocking rib and groove profile elements 1016 and 1017. (U.S. Pat. No. 5,007,143, Col. 5, lines 43–49).

The interlocking fastening strips may be manufactured by extrusion through a die. The interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips. For example, the fastening strips may be made from low density polyethylene.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. For example, the bag may be made from a mixture of high pressure, low density polyethylene and linear, low density polyethylene.

The fastening strips may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the fastening strips or expected additional manufacturing operations.

The fastening strips can be manufactured in a variety of forms to suit the intended use. The fastening strips may be integrally formed on the opposing sidewalls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. In addition, all references and copending applications cited herein are hereby incorporated by reference in their entireties.

What is claimed is:

1. A closure device, comprising:

first and second interlocking fastening strips arranged to be interlocked over a predetermined longitudinal X axis between first and second ends, the fastening strips having a transverse Y axis, the transverse Y axis being perpendicular to the longitudinal X axis, the fastening strips having a vertical Z axis, the vertical Z axis being perpendicular to the longitudinal X axis, the vertical Z axis being perpendicular to the transverse Y axis; and a slider slidably disposed on the fastening strips for movement between the first and second ends, the slider facilitating occlusion of the fastening strips when moved towards the first end, the slider facilitating the deocclusion of the fastening strips when the slider is moved towards the second end, wherein the slider includes a first side portion, a second side portion and a top portion, the slider has an upper portion and a lower portion, the upper portion being adjacent the top portion, a first gripping surface is located on the first side portion at the upper portion of the slider, the slider includes a first shoulder located on the first side portion at the lower portion of the slider, the first gripping surface and the first shoulder being offset from each other relative to the Z axis.

2. The invention as in claim 1 wherein the first and second side portions are separated by a first distance when the slider is not being gripped by the user, the first distance remains substantially the same when being gripped by the user to move the slider.

3. The invention as in claim 1 wherein the first gripping surface extends laterally along the upper portion of the slider.

4. The invention as in claim 1 wherein the first gripping surface includes an inwardly protruding radial surface.

5. The invention as in claim 1 wherein the first gripping surface extends outwardly from the first side portion.

6. The invention as in claim 1 wherein the first gripping surface includes two outwardly protruding bumps.

7. The invention as in claim 1 wherein a second gripping surface is located on the second side portion of the slider.

8. A container comprising:

first and second sidewalls joined at seams to form a compartment with an opening;

first and second interlocking fastening strips respectively connected to the first and second sidewalls at the opening, the fastening strips arranged to be interlocked over a predetermined longitudinal X axis between first and second ends, the fastening strips having a transverse Y axis, the transverse Y axis being perpendicular to the longitudinal X axis, the fastening strips having a vertical Z axis, the vertical Z axis being perpendicular to the longitudinal X axis, the vertical Z axis being perpendicular to the transverse Y axis; and a slider slidably disposed on the fastening strips for movement between the first and second ends, the slider facilitating occlusion of the fastening strips when moved towards the first end, the slider facilitating the deocclusion of the fastening strips when the slider is moved towards the second end, wherein the slider includes a first side portion, a second side portion and a top portion, a first gripping surface is located on the first side portion of the slider, a first shoulder is located on the first side portion of the slider, the first gripping surface and the first shoulder being offset from each other relative to the Z axis.

9. A method of manufacturing a closure device, comprising:

providing first and second interlocking fastening strips arranged to be interlocked over a predetermined longitudinal X axis between first and second ends, the fastening strips having a transverse Y axis, the transverse Y axis being perpendicular to the longitudinal X axis, the fastening strips having a vertical Z axis, the vertical Z axis being perpendicular to the longitudinal X axis, the vertical Z axis being perpendicular to the transverse Y axis; and providing a slider slidably disposed on the fastening strips for movement between the first and second ends, the slider facilitating occlusion of the fastening strips when moved towards the first end, the slider facilitating the deocclusion of the fastening strips when the slider is moved towards the second end, wherein the slider includes a first side portion, a second side portion and a top portion, a first gripping surface is located on the first side portion of the slider, a first shoulder is located on the first side portion of the slider, the first gripping surface and the first shoulder being offset from each other relative to the Z axis.

10. A closure device, comprising:

first and second interlocking fastening strips arranged to be interlocked over a predetermined X axis between first and second ends; and a slider slidably disposed on the fastening strips for movement between the first and second ends, the slider facilitating occlusion of the fastening strips when moved towards the first end, the slider facilitating the deocclusion of the fastening strips when the slider is moved towards the second end, wherein the slider includes a first side portion, a second side portion and a top portion, a first protruding portion disposed along the first side portion of the slider, the slider has a front portion and a rear portion, the first protruding portion causes the user to grip the slider at the front portion or at the rear portion, the first protruding portion includes an outwardly protruding radial surface, the radial surface extends along the entire length of the first side portion.

11. The invention as in claim 10 wherein the second side portion includes a second protruding portion.

12. A closure device, comprising:

first and second interlocking fastening strips arranged to be interlocked over a predetermined X axis between first and second ends; and a slider slidably disposed on the fastening strips for movement between the first and second ends, the slider facilitating occlusion of the fastening strips when moved towards the first end, the slider facilitating the deocclusion of the fastening strips when the slider is moved towards the second end, wherein the slider includes a first side portion, a second side portion and a top portion, a first protruding portion disposed along the first side portion of the slider, the slider has a front portion and a rear portion, the first protruding portion causes the user to grip the slider at the front portion or at the rear portion, the first protruding portion includes two outwardly protruding linear surfaces disposed to join at the center of the first side portion.

13. The invention as in claim 12 wherein the first protruding portion extends laterally along the length of the first side portion.

14. The invention as in claim 12 wherein the second side portion includes a second protruding portion.

* * * * *